United States Patent [19]

Iwamoto

[11] Patent Number: 4,949,009

[45] Date of Patent: Aug. 14, 1990

[54] SHADOW MASK MOUNTING SYSTEM FOR A COLOR CATHODE RAY TUBE

[75] Inventor: Toshikazu Iwamoto, Nagaokakyo, Japan

[73] Assignee: Mitsubishi Denki Kabushiki Kaisha, Tokyo, Japan

[21] Appl. No.: 305,405

[22] Filed: Feb. 2, 1989

[30] Foreign Application Priority Data

Feb. 3, 1988 [JP] Japan ..... 63-24289
Feb. 3, 1988 [JP] Japan ..... 63-24290

[51] Int. Cl.[5] ..... H01J 29/07
[52] U.S. Cl. ..... 313/407
[58] Field of Search ..... 313/402, 407, 408

[56] References Cited

U.S. PATENT DOCUMENTS 3,936,691 2/1976 Bakker et al. ..... 313/407
4,327,307 4/1982 Penird et al. ..... 313/407
4,437,036 3/1984 Ragland, Jr. ..... 313/407 X
4,739,216 4/1988 Yamazaki et al. ..... 313/407

*Primary Examiner*—Sandra L. O'Shea

[57] ABSTRACT

A shadow mask mounting in a color cathode ray tube comprising an evacuated envelope having a longitudinal axis and including a generally rectangular faceplate, which faceplate is sealed to one of opposite ends of the evacuated envelope and includes a phosphor deposited screen lying generally perpendicular to the longitudinal axis. The mounting comprises a generally rectangular rigid support frame, a finely perforated shadow mask mounted across the support frame and having a skirt connected to the support frame, a plurality of positioning engagements formed in one of the skirt of the perforated shadow mask and the support frame, and a corresponding number of mating engagements formed in the other of the skirt of the perforated shadow mask and the support frame so that, when the perforated shadow mask is mounted on the support frame, the positioning engagements can be engaged with the mating engagements to position the shadow mask relative to the support frame in a plane perpendicular to the longitudinal axis of the evacuated envelope.

24 Claims, 6 Drawing Sheets

SHADOW MASK MOUNTING SYSTEM FOR A COLOR CATHODE RAY TUBE

BACKGROUND OF THE INVENTION

1. Field of the Invention

The present invention generally relates to a color cathode ray tube and, more particularly, to a mounting of a perforated shadow mask in the color cathode ray tube.

2. Description of the Prior Art

It is well known that the color cathode ray tube utilized as a display of, for example, a television receiver set employs a generally rectangular perforated shadow mask assembly including a perforated shadow mask which is made of a perforated thin metal plate or foil. The perforated thin metal plate or foil, that is, the perforated shadow mask, has a multiple of minute circular or elongated apertures defined therein in a predetermined pattern corresponding to the triads of primary color elemental phosphor dots on the inner surface of the faceplate which forms a part of the highly evacuated envelope.

When it comes to the manner by which the rectangular perforated shadow mask is supported inside the faceplate in the vicinity of the luminescent phosphor-deposited screen, a generally rectangular rigid support frame is employed so as to intervene between the periphery of the perforated shadow mask and the faceplate.

More specifically, as shown in FIG. 1 of the accompanying drawings showing the conventional color cathode ray tube in exploded view, the color cathode ray tube comprises a highly evacuated envelope including a generally rectangular faceplate 1, a funnel section 3 and a generally cylindrical neck section 4, and an electron gun assembly 6 housed within the neck section 4 for emitting three electron beams of three primary elemental colors, that is, red, green and blue. The funnel section 3 is closed at one end by the neck section 4 and at the other end by the faceplate 1. The faceplate 1 is generally in the form of a cup-shaped envelope cap including a generally spherical screen plate 1*a* and a peripheral side wall assembly 1*b* which protrudes generally perpendicular to the screen plate 1*a* in a direction generally parallel to the longitudinal axis of the envelope shown by the arrow Z and which is sealed to the funnel section. The inner surface of the screen plate 1*a* confronting the interior of the evacuated envelope has a substantially rectangular area, that is, a substantially rectangular phosphor deposited area 1*c* (FIG. 3), where triads of phosphor dots are deposited in a predetermined pattern.

A perforated shadow mask assembly generally identified by 2 in FIG. 1 is positioned inside the side wall assembly 1*b* of the faceplate 1 and retained in position by means of a plurality of mounting spring members 5, the details of said perforated shadow mask assembly 2 being shown in FIG. 2. As best shown in FIG. 2, the perforated shadow mask assembly 2 comprises a generally rectangular color selection electrode member or finely perforated shadow mask 21 having a perforated plate and a mounting skirt 23 generally perpendicular to the perforated plate, and a support frame 22, said mounting spring members 5 being fixed exteriorly to the support frame 22. The perforated shadow mask 21 is retained in position inwardly of the support frame 22 with the mounting skirt 23 received in and welded to the support frame 22 while confronting, and spaced a predetermined distance inwardly from, the screen plate 1*a*.

As is well known to those skilled in the art, the finely perforated shadow mask 21 has the perforated plate which is of a generally spherical shape similar to the shape of the screen plate 1*a* of the faceplate 1. In order for the perforated shadow mask 21 to be supported rigidly by the support frame 22, the support frame 22 generally used in the conventional cathode ray tube is made with the use of either hot rolled thin steel plate or cold rolled thin steel plate having a thickness within the range of 0.8 to 2.5 mm, into a generally rectangular shape as shown in FIG. 2.

The perforated shadow mask 21 is operable to allow the selective passage therethrough of the electron beams emitted from the electron gun assembly 6 and, for this purpose, the perforated plate of the shadow mask 21 is formed with a multiple of minute circular or elongated apertures 24, for example, either circular through-holes or slots, defined therein in a predetermined pattern corresponding to the triads of primary color elemental phosphor dots on the inner surface of the screen plate 1*a*. That area of the perforated plate of the shadow mask 21 where the minute circular or elongated apertures 24 are actually formed is substantially rectangular in shape as shown by the phantom line 25, which area is hereinafter referred to as a perforated area.

As far as the manufacture of the color cathode ray tube is concerned, the minute apertures 24 defined in the perforated plate of the shadow mask 21, which operate to allow the selective passage of the electron beams during the operation of the color cathode ray tube, are utilized as a registration member for registering the substantially rectangular phosphor deposited area 1*c* of the screen plate 1*a* during an exposure step during which exposure lights are allowed to pass through the minute apertures 24 for the purpose of formation of the substantially rectangular phosphor deposited area 1*c* on the screen plate 1*a* in a centered fashion with respect to the substantially rectangular apertured area 25 of the shadow mask 21.

If, in the course of manufacture of the conventional color cathode ray tube of the above described construction, the perforated shadow mask 21 is supported with the rectangular perforated area 25 thereof laterally displaced or rotated relative to the screen plate 1*a* of the faceplate 1, at the time of execution of the exposure step in which the substantially rectangular phosphor deposited area of the screen plate 1*a* is exposed to the exposure lights, the resultant rectangular phosphor deposited area 1*c* of the screen plate 1*a* would have its center P displaced laterally in a plane generally perpendicular to the longitudinal axis Z of the evacuated envelope (that is, in an X-Y plane containing X- and Y-axes perpendicular to each other and also perpendicular to the longitudinal axis Z of the evacuated envelope) from the position Po (or the center of the screen plate 1*a*) where it ought to have occupied as shown in FIG. 3(*a*), or would be angularly offset relative to the screen plate 1*a* about the longitudinal axis Z of the evacuated envelope as shown in FIG. 3(*b*). Once the rectangular phosphor deposited area 1*c* is formed on the inner surface of the screen plate 1*a* in such a distorted fashion, the resultant color cathode ray tube would exhibit an undesirable displaced reproduction of televised color pictures, rendering the color cathode ray tube to be unacceptable for commercial use.

One of the major causes of the displaced reproduction of the televised pictures will now be discussed. In the case of the color cathode ray tube wherein the perforated shadow mask 21 is fixedly welded at its peripheral edge to an inner wall face of the support frame 22 through the skirt 23 such as discussed hereinbefore, it may often occur that, because of the presence of an insufficient and/or uneven clearance between the the skirt 23 integral with the perforated shadow mask 21 and the inner wall face of the support frame 22 to which it is welded, the perforated shadow mask 21 may be fixed in position inside the support frame 22 in a manner laterally displaced or angularly offset relative to the support frame 22 as shown in FIG. 3(*c*) or FIG. 3(*d*).

By way of example, in the case of the 37-inch color cathode ray tube, the rectangular aperture area 25 of the perforated shadow mask 21 generally has a width of about 640 mm as measured along any one of the opposite long sides thereof. If the perforated shadow mask 21 is fixed to the support frame 22 while having been angularly offset, or rotated, about the longitudinal axis Z of the evacuated envelope and inclined at an angle of 0.4° at relative to the X-axis passing through the center Po of the screen plate 1*a*, the amount of angular offset of the rectangular phosphor deposited area 1*c* on the screen plate 1*a* as indicated by d in FIG. 3(*b*) would be about 5 mm, resulting in the undesirable rotated reproduction of color pictures.

In order to avoid the distorted reproduction of the televised pictures, the perforated shadow mask has to be accurately and precisely supported in position inside the support frame without being laterally displaced or angularly offset. This is particularly true where the color cathode ray tube employs the perforated shadow mask assembly of a type wherein the perforated shadow mask is welded to the support frame.

According to the prior art, the use is required of complicated and expensive centering and/or positioning machines and equipment for accurately and precisely positioning the perforated shadow mask relative to the support frame during the assembly of the perforated shadow mask assembly. Considering the presence of deviations from a batch of cathode ray tubes to another during the manufacture thereof, the use of the complicated and expensive centering and/or positioning machines and equipment does not pay.

The U.S. Pat. No. 4,327,307, issued Apr. 27, 1982, to Penird et al., discloses a perforated shadow mask assembly for color cathode ray tubes which comprises a plurality of spaced protuberances formed on the support frame for providing the welding locations for the perforated shadow mask and thus providing a space between the wall of the support frame and the skirt of the perforated shadow mask so that both of the stresses normally introduced into the perforated shadow mask when it is welded to the support frame and the tendency of the perforated shadow mask to dome during heating can be reduced. The perforated shadow mask disclosed therein has the skirt telescoped over and welded to the protuberances formed on the support frame.

In any event, the purpose of use of the protuberances in said U.S. Patent is, as clearly discussed therein, to relieve the strain normally applied to the perforated shadow mask during the welding and also to reduce the effect of doming. As is well known to those skilled in the art, the doming of the perforated shadow mask is the phenomenon in which the perforated shadow mask expands outwardly towards the phosphor deposited screen under the influence of heats evolved in the perforated shadow mask assembly as a result of impingement of electron beams during the passage thereof through the apertures in the perforated shadow mask. Accordingly, it is clear that the invention of the U.S. Patent is not useful for repositioning of the perforated shadow mask accurately and precisely relative to the phosphor deposited area on the screen plate.

SUMMARY OF THE INVENTION

The present invention has accordingly been devised with a view to substantially eliminating the above discussed problems inherent in the prior art perforated shadow mask mounting systems and is intended to provide an improved perforated shadow mask mounting system effective to provide a color cathode ray tube wherein the perforated shadow mask can be accurately and precisely positioned relative to the support frame without relying on the use of any complicated and expensive centering and/or repositioning machines and equipment during the assembly of the color cathode ray tube and, therefore, the perforated shadow mask can be neither laterally displaced nor angularly offset relative to any one of the support frame and the rectangular phosphor deposited area on the screen plate.

Another important object of the present invention is to provide an improved perforated shadow mask mounting system of the type referred to above, wherein a uniform clearance can be formed all over the periphery between the perforated shadow mask and the support frame, signifying that the rectangular perforated area of the shadow mask supported by the support frame can easily and exactly aligned with the rectangular phosphor deposited area of the screen plate.

In order to accomplish the above described objects of the present invention, the present invention herein disclosed provides a perforated shadow mask mounting system in a cathode ray tube which comprises an evacuated envelope having a longitudinal axis and including a generally rectangular faceplate, which faceplate includes a phosphor deposited screen plate lying generally perpendicular to the longitudinal axis, and sealed to one of opposite ends of the evacuated envelope. The shadow mask mounting comprises a shadow mask assembly including a generally rectangular rigid support frame and a finely perforated shadow mask mounted across the support frame and having a skirt connected to the support frame, a plurality of positioning engagements formed in and spacedly distributed around the skirt of the perforated shadow mask, and a corresponding number of mating engagements formed in the support frame so that, when the perforated shadow mask is mounted on the support frame, the engagements in the skirt can be engaged with the mating engagements in the support frame to position the shadow mask relative to the support frame in a plane perpendicular to the longitudinal axis of the evacuated envelope.

According to the present invention, because of the employment of the positioning engagements in the skirt of the perforated shadow mask and the mating engagements in the support frame, the mounting of the perforated shadow mask on the support frame can result in the substantially exact and accurate positioning of the perforated shadow mask relative to the support frame in the plane perpendicular to the longitudinal axis with a uniform clearance defined between the wall face of the support frame and the skirt of the perforated shadow mask all over the circumference of the support frame.

In one preferred embodiment of the present invention, each of the engagements formed in the skirt of the perforated shadow mask may comprise a resilient tongue formed by cutting a corresponding portion of the skirt so as to protrude towards the frame. In this case, each of the mating engagements formed in the support frame may comprise a flat area of the support frame with which the corresponding resilient tongue can elastically engaged when the shadow mask is mounted on the support frame.

According to the above described preferred embodiment of the present invention, when the shadow mask is mounted on the support frame, the resilient tongues are engaged to the respective flat areas of the support frame and are, therefore, yielded against their own resiliency in contact with the flat areas of the support frame while exerting forces necessary to cause the shadow mask to be retained in position on the support frame with a uniform clearance defined therebetween. Accordingly, the shadow mask can be substantially accurately and precisely positioned on the support frame in the plane perpendicular to the longitudinal axis of the evacuated envelope and, consequently, the substantially rectangular perforated area of the shadow mask can be advantageously easily aligned with the substantially rectangular phosphor deposited area of the screen plate.

In another preferred embodiment of the present invention, each of the positioning engagements formed in the skirt of the perforated shadow mask may comprise a generally V-sectioned or semicircular cross-sectioned projection protruding either outwardly or inwardly from the skirt of the perforated shadow mask, in which case each of the mating engagements formed in the support frame has to have a shape complemental to the shape of the V-sectioned or semicircular cross-sectioned projection so that, when the shadow mask is mounted on the support frame, the projections in the skirt can be snugly received in the mating engagements in the support frame.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined solely by the appended claims. In the drawings, like reference numerals denote like parts in the several views.

FIGS. 3(*c*) and 3(*d*) are schematic diagrams used to explain different types of deviation between the support frame and the perforated shadow mask;

DETAILED DESCRIPTION OF THE EMBODIMENTS

In describing the preferred embodiments of the present invention, reference will be made to the color TV receiver set although the present invention can be equally applicable to the cathode ray tube employed in any other display apparatus, for example, a computer display device.

Figure 1:
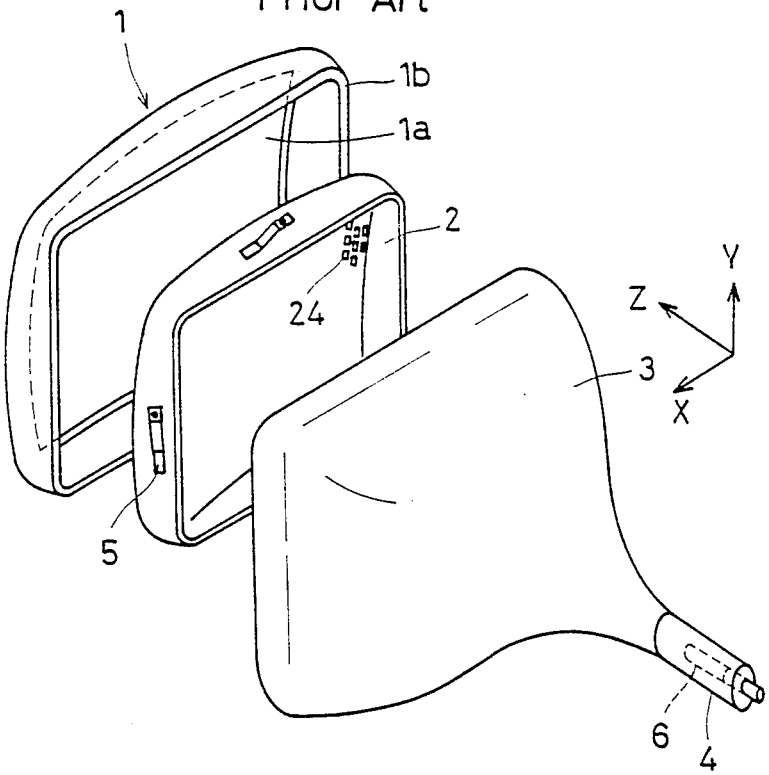
Fig. 1 Prior Art
FIG. 1 is an exploded view of the prior art color cathode ray tube as viewed from rear.
Figure 2:
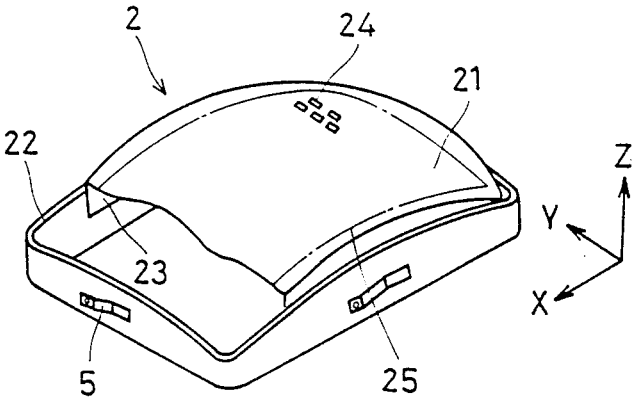
Fig. 2 Prior Art
FIG. 2 is a perspective view, with a portion cut away, of the perforated shadow mask assembly used in the prior art color cathode ray tube shown in FIG. 1.
Figure 3A:
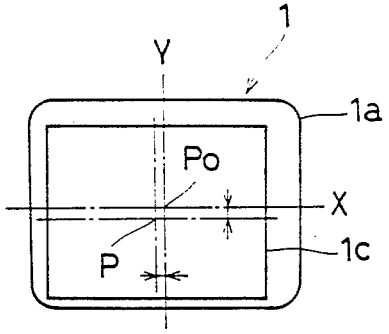
FIGS. 3(*a*) and 3(*b*) are schematic diagrams used to explain different types of deviation between the phosphor deposited area on the inner surface of a screen plate of the faceplate relative to the screen plate.
Figure 3B:
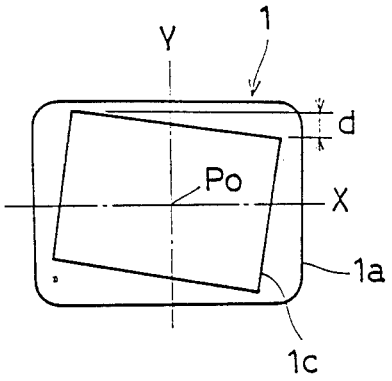
Figure 3C:
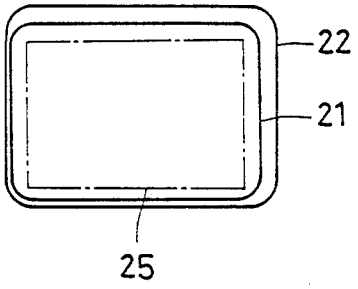
Figure 3D:
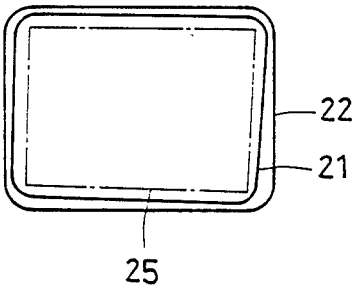

The highly evacuated envelope comprises, as is the case with the color cathode ray tube shown in FIG. 1, a funnel section 3 closed at one end by a generally cylindrical neck section 4 and at the other end by a generally rectangular faceplate 1. The rectangular faceplate 1 is generally in the form of a cup-shaped envelope cap including a screen plate 1*a* and a peripheral side wall 1*b* which is sealed to the funnel section 3. The screen plate 1*a* has an inner surface thereof deposited with triads of phosphor dots in a pattern corresponding to the pattern of minute elongated apertures 24 in the perforated shadow mask 21.

In order for the shadow mask 21 to be supported inside the evacuated envelope, particularly within the space delimited by the screen plate 1*a* and the peripheral side wall 1*b* of the faceplate 1, in the vicinity of the luminescent phosphor deposited area 1*c*, a generally rectangular rigid support frame 22 is employed so as to intervene between the periphery of the perforated shadow mask 21 and the envelope. The support frame 22 protrudes towards the screen plate 1*a* in a direction parallel to the longitudinal sense Z of the envelope is retained in position within the envelope in a manner well known to those skilled in the art. The perforated shadow mask 21 has the generally spherical perforated area 25 and a skirt 23 protruding axially parallel to the longitudinal axis Z of the envelope is mounted with the skirt 23 snugly received in the support frame 22 while confronting, and spaced a predetermined distance inwardly from, the screen plate 1*a* of the faceplate 1.

Figure 4:
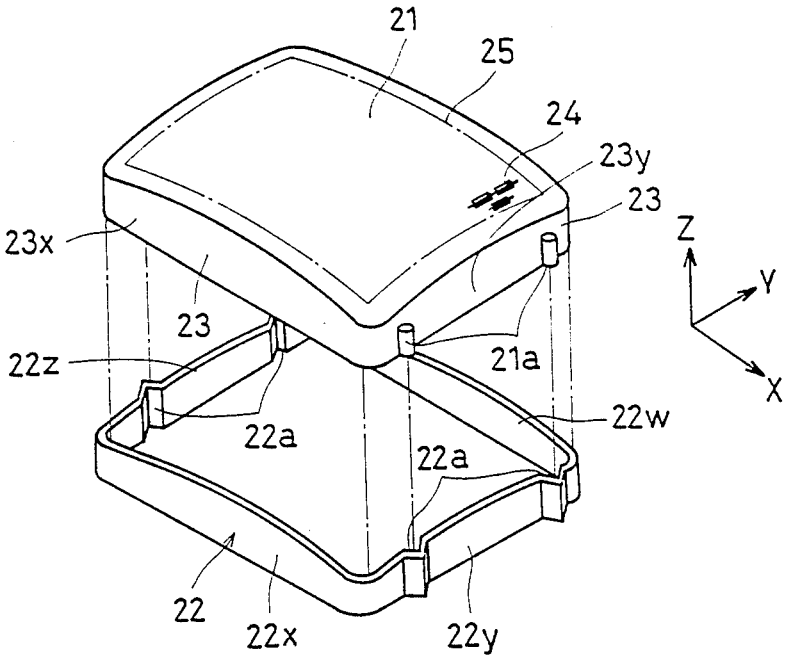
FIG. 4 is an exploded view of a perforated shadow mask assembly used in a color cathode ray tube according to a first preferred embodiment of the present invention.
Figure 5:
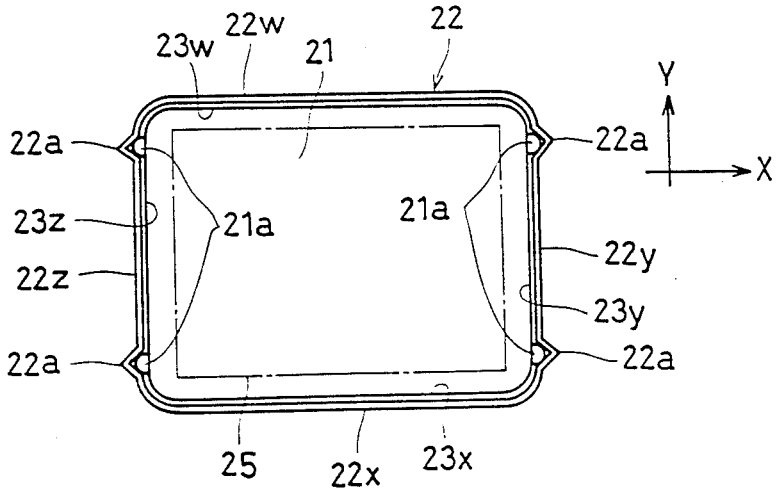
FIG. 5 is an front elevational view of the perforated shadow mask assembly shown in FIG. 4, with the perforated shadow mask mounted on the support frame.

Referring now to FIGS. 4 and 5, for the purpose of description of the present invention, the support frame 22 is comprised of a pair of longer side walls 22*w* and 22*x* and a pair of shorter side walls 22*y* and 22*z*, all configured so as to represent a generally rectangular shape, whereas the skirt 23 of the perforated shadow mask 21 is comprised of a pair of longer side walls 23*w* and 23*x* and a pair of shorter side walls 23*y* and 23*z*, all configured so as to similarly represent a generally rectangular shape.

In accordance with the teachings of the present invention, a plurality of positioning engagements each in the form of generally elongated and generally semicircular cross-sectioned projections 21*a* are formed two in each of the shorter side walls 23*y* and 23*z* in spaced relation to each other and adjacent two of the four corners of the skirt 23 with the longitudinal sense of each projections 21*a* lying parallel to the longitudinal axis Z of the envelope. Those projections 21*a* can be readily formed in the skirt 23 of the perforated shadow mask 21 by the use of any well known press work either simultaneously or separately with the shaping of the perforated shadow mask 21.

In correspondence with the projections 21*a* in the skirt 23 of the perforated shadow mask 21, the support frame 22 is provided with a corresponding number of mating engagements which are employed in the form of recesses generally identified by 22*a* , each two of said recesses 22*a* being formed in the respective shorter side wall 22*y* and 22*z* of the support frame 22. So far shown, each of the recesses 22*a* formed in the shorter side walls 22*y* and 22*z* of the support frame 22 corresponds in position to the associated projection 21*a* in the skirt 23 of the perforated shadow mask 21 and is employed in the form of a generally V-sectioned groove.

It is to be noted that the formation of each two of the projections 21*a* in the associated shorter side wall 23*y* or 23*z* adjacent the corners is preferred because those portions of each shorter side wall 23*y* or 23*z* adjacent the corners of the skirt 23 is relatively rigid as compared with a generally intermediate portion of such shorter side wall 23*y* or 23*z* and, therefore, during either the formation of the projections 21*a* in the skirt 23 or the mounting of the perforated shadow mask 21 relative to the support frame 22, any possible deviation in position of the projections 21*a* can be avoided. This can equally apply to the formation of each two of the recesses 22*a* in the respective shorter-side wall 22*y* or 22*z* of the support frame 22.

When the perforated shadow mask 21 having the projections 21*a* formed in the skirt 23 as hereinabove described is mounted relative to the support frame 22 with the projections 21*a* snugly received in the recesses 22*a* formed in the support frame 22, the resultant assembly assumes such a condition as shown in FIG. 5. In the condition shown in FIG. 5, the perforated shadow mask 21 is accurately positioned inside the support frame 22 while lying in an X-Y plane containing the X- and Y-axes both perpendicular to the longitudinal axis Z of the evacuated envelope. With the perforated shadow mask 21 so mounted, the skirt 23 of the perforated shadow mask 21 is subsequently welded at a plurality of welding locations to the support frame 22, thereby completing the perforated shadow mask assembly according to the present invention.

Referring to the condition shown in FIG. 5, since each of the projections 21*a* in the perforated shadow mask 21 is of a generally semicircular cross-section having a generally cylindrical side face confronting laterally outwardly of the skirt 23 whereas each of the recesses 22*a* in the support frame 22 is of a generally V-shaped cross-section having a pair of flat side faces adjoined to represent the shape of a figure "V" and confronting laterally inwardly of the support frame 22, the mounting of the perforated shadow mask 21 relative to the support frame 22 results in the formation of a pair of line contacts between each projection 21*a* and the respective V-shaped recess 22*a*. Because of this reason, the perforated shadow mask 21 can be firmly retained in position inside the support frame 22 in the X-Y plane perpendicular to the longitudinal axis Z without being laterally displaced or angularly offset and with an advantageously uniform clearance developed between the skirt 23 and the support frame 22 all over the circumference thereof Therefore, during the welding of the skirt 23 to the support frame 22, the perforated shadow mask 21 will neither undergo any lateral displacement nor any angular offset relative to the support frame 22.

Figure 6:
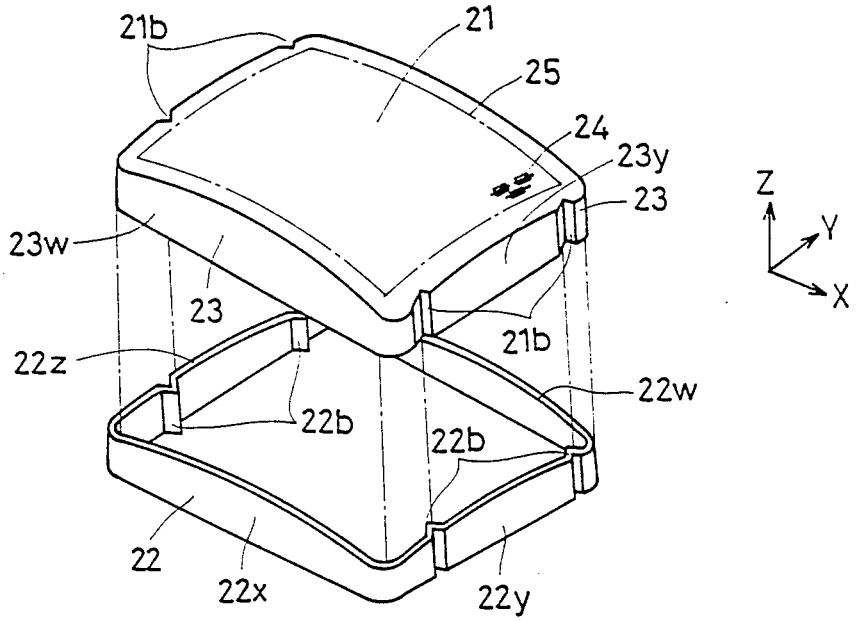
FIG. 6 is an exploded view of the perforated shadow mask assembly according to a second preferred embodiment of the present invention.
Figure 7A:
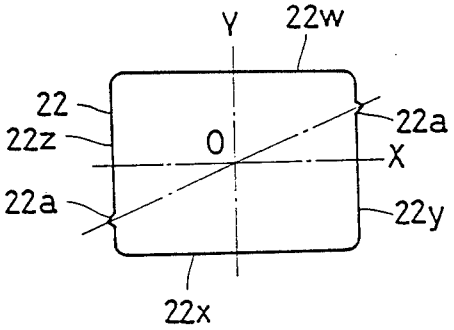
FIGS. 7(*a*) to 7(*d*) are schematic diagrams of respective modified forms of mating engagements defined in the support frame.
Figure 7B:
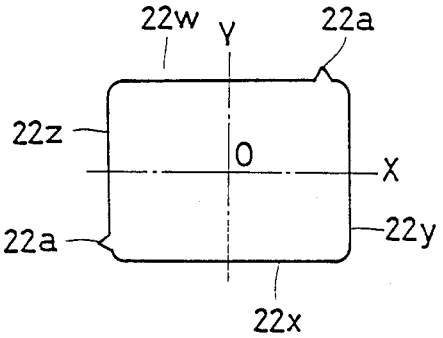
Figure 7C:
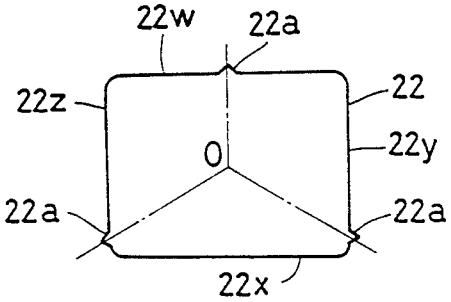
Figure 7D:
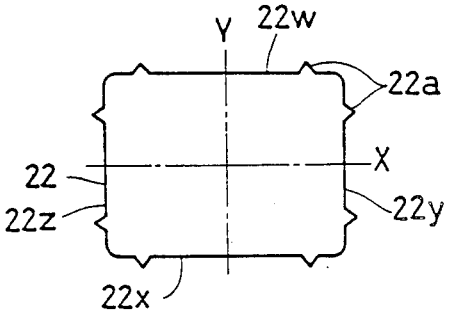

It is to be noted that the generally elongated, generally semicircular cross-sectioned projections and the generally V-sectioned recesses, which have been described as formed in the skirt 23 of the perforated shadow mask 21 and the support frame 22, respectively, in the foregoing embodiment of FIGS. 4 and 5, may be reversed in position relative to each other such as shown in FIG. 6. More specifically, according to the embodiment shown in FIG. 6, each positioning engagement formed in the skirt 23 of the perforated shadow mask 21 is employed in the form of a generally V-sectioned recess 21*b* depressed inwardly of the skirt 23 whereas each mating engagement formed in the support frame 22 is employed in the form of a generally elongated and generally semicircular cross-sectioned projection 22*b* protruding inwardly of the support frame 22.

Not only can the perforated shadow mask assembly according to the embodiment shown in FIG. 6 operate in a manner similar to that according to the embodiment of FIGS. 4 and 5, but also the perforated shadow mask assembly according to the embodiment shown in FIG. 6 can bring about effects similar to those afforded by that according to the embodiment of FIGS. 4 and 5.

It is to be noted that, in the foregoing description of any one of the first and second preferred embodiment of the present invention shown in and described with reference to FIGS. 4 and 5 and FIG. 6, respectively, reference has been made to the use of the four positioning engagements and the corresponding number of the mating engagements. However, the number of the positioning engagements as well as the number of the mating engagements may not be limited to four such as shown and described, and the number of the mating engagements to be formed in the skirt 23 of the perforated shadow mask 21 as well as that of the mating engagements to be formed in the support frame 22 is to be so chosen that, when the perforated shadow mask 21 is mounted relative to the support frame 22 in the manner hereinbefore described, the position of the perforated shadow mask 21 in the X-Y plane perpendicular to the longitudinal axis Z and relative to the support frame 22 is determined, and any possible lateral displacement and/or any possible angular offset of the perforated shadow mask 21 relative to the support frame 22 will not occur.

By way of example, the first preferred embodiment of the present invention shown in and described with reference to FIGS. 4 and 5 may be modified in various ways as shown in FIGS. 7(*a*) to 7(*d*), respectively. In the example shown in FIG. 7(*a*), the two generally V-sectioned recesses 22*a* are employed as formed each in the shorter side wall 22*y* and 22*z* and are so positioned in symmetrical relationship with respect to each other about the longitudinal axis Z of the evacuated envelope. In the example shown in FIG. 7(*b*), the two generally V-sectioned recesses 22*a* are formed in one of the shorter side walls of the support frame 22, for example, the shorter side wall 22*z*, and one of the longer side walls of the support frame 22, that is, the longer side wall 22*w*, adjacent the diagonally opposed corners of the support frame 22, respectively.

In the example shown in FIG. 7(*c*), the three generally V-sectioned recesses 22*a* are formed, one in a substantially intermediate portion of one of the longer side walls, for example, the longer side wall 22*w*, of the support frame 22 and the remaining two in the shorter side walls 22*y* and 22*z* adjacent the respective corners defined between the opposite ends of the other of the longer side walls, that is, the longer side wall 22*x*, and the shorter side walls 22*y* and 22*z*. More specifically, the three recesses 22*a* shown in FIG. 7(*c*) are so positioned as to occupy respective apexes of the shape of a triangle.

In the example shown in FIG. 7(*d*), the two generally V-sectioned recesses 22*a* are formed in each of the longer and shorter side walls 22*w*, 22*x*, 22*y* and 22*z* adjacent the four corners of the support frame 22.

It is to be noted that, where recesses 22*a* in the support frame 22 are so formed and so positioned as shown in any one of FIGS. 7(*a*) to 7(*d*), the projections 21*b* formed in the skirt 23 of the perforated shadow mask 21 has to be formed in a corresponding number and at corresponding positions. It is also to be noted that, even in any one of the modifications shown respectively in FIGS. 7(*a*) to 7(*d*), the projections and the recesses, which have been described as formed in the skirt 23 of the perforated shadow mask 21 and the support frame 22, respectively, may be reversed in position relative to each other, that is, may be formed in the support frame 22 and the skirt 23 of the perforated shadow mask 21, respectively.

Also, instead of the employment of the generally elongated, generally semicircular cross-sectioned projections in combination with the generally V-sectioned recesses to provide the line contacts therebetween, one of the projections and the recesses may have any suitable cross-sectional shape, in which case the other of the projections and the recesses should have a cross-sectional shape complemental to the cross-sectional shape of such one of the projections and the recesses so that the both can engage with each other. By way of example, one of the projections and the recesses may have a generally semicircular cross-sectional shape, and the other of the projections and the recesses may have a complemental semicircular cross-sectional shape, that is, a generally U-sectioned shape to provide a face contact therebetween.

Furthermore, the projections whetherever formed in the skirt 23 of the perforated shadow mask 21 such as shown in FIGS. 4 and 5 or whetherever formed in the support frame 22 such as shown in FIG. 6, may comprise separate members, in which case the separate members should be welded to the skirt 23 or the support frame 22 thereby to complete the projections.

Thus, according to the present invention, because of the employment of the positioning engagements in the skirt of the perforated shadow mask and the mating engagements in the support frame, the mounting of the perforated shadow mask on the support frame can result in the substantially exact and accurate positioning of the perforated shadow mask relative to the support frame in the X-Y plane perpendicular to the longitudinal axis Z with a uniform clearance defined between the wall face of the support frame and the skirt of the perforated shadow mask all over the circumference of the support frame. Therefore, the use of any complicated and expensive centering and/or repositioning machines and equipment hitherto required in the manufacture of the color cathode ray tube is not necessary and, yet, the resultant perforated shadow mask assembly can be accurately and precisely aligned with the rectangular phosphor deposited area 1*c* on the screen plate 1*a* (FIGS. 3(*a*) and 3(*b*)), thereby obviating the problems associated with the undesirable rotated color reproduction through the color cathode ray tube.

Figure 8:
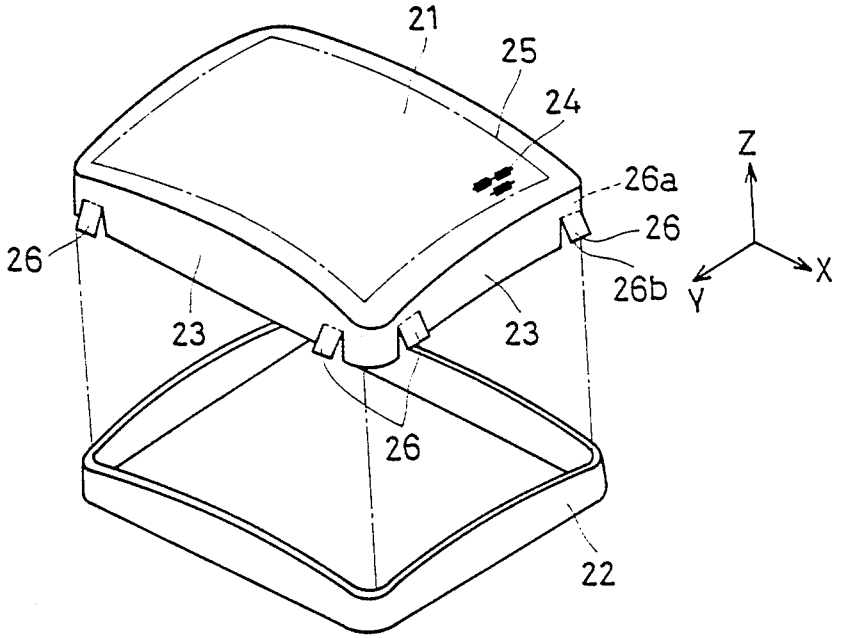
FIG. 8 is an exploded view of the perforated shadow mask assembly according to a third preferred embodiment of the present invention.
Figure 9:
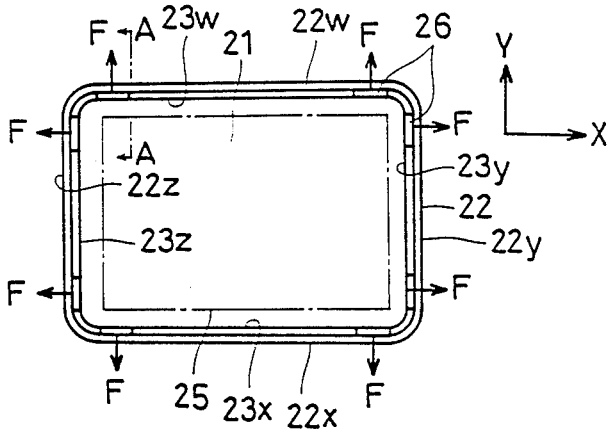
FIG. 9 is a front elevational view of the perforated shadow mask assembly shown in FIG. 8, with the perforated shadow mask mounted on the support frame.
Figure 10:
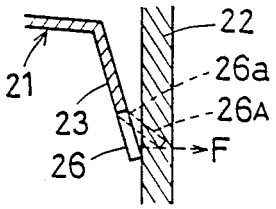
FIG. 10 is a schematic cross-sectional view taken along the line A—A in FIG. 9.

In the embodiment shown in FIGS. 8 to 10, the positioning engagements formed in the skirt 23 of the perforated shadow mask 21 comprise generally rectangular flat resilient tongues, generally identified by 26, which are formed by cutting respective portions of the skirt 23 inwardly from the circumferential lip of the skirt 23 opposite to the perforated shadow mask 21 and then raising those portions of the skirt 23 outwardly from the remaining portion of the skirt 23. So far illustrated, two of the resilient tongues 26 are formed in each of the longer side walls 23*w* and 23*x* of the skirt 23 adjacent the corners of the skirt 23 and two of the resilient tongues 26 are formed in each of the shorter side walls 23*y* and 23*z* of the skirt 23 adjacent the corners of the skirt 23.

The mounting of the perforated shadow mask 21 relative to the support frame 22 can be accomplished by pressing the resilient tongues 26 inwardly of the skirt 23 against their own resiliency to allow the skirt 23 to be received inside the support frame 22. When the resilient tongues 26 are so inwardly pressed against their own resiliency, the resilient tongues 26 accumulate biasing forces F tending to cause the respective resilient tongues 26 to restore to the original shapes shown by the phantom line 26A in FIG. 10.

When the perforated shadow mask 21 is so mounted, such a condition as shown in FIG. 9 occurs wherein the resilient tongues 26 tending to expand outwardly of the skirt 23 by the effect of the biasing forces F accumulated therein in the manner as hereinabove described are brought into contact with respective inner wall faces of the longer and shorter side walls 22*w*, 22*x*, 22*y* and 22*z* of the support frame 22 as shown in FIG. 9. Since the biasing forces F exerted by the resilient tongues 26 in the longer side walls 23*w* and 23*x* of the skirt 23 act in respective directions opposite to each other and in a direction parallel to the Y-axis and the biasing forces F exerted by the resilient tongues 26 in the shorter side walls 23*y* and 23*z* of the skirt act in respective directions opposite to each other and in a direction parallel to the X-axis and perpendicular to the directions in which the biasing forces of the resilient tongues 26 in the longer side walls 23*w* and 23*x* of the skirt, and if the first mentioned biasing forces F acting in the Y-axis are equal and the second mentioned biasing forces F acting in the X-axis are also equal, the perforated shadow mask 21 can be accurately retained in position inside the support frame 22 in the X-Y plane perpendicular to the longitudinal axis Z with a uniform clearance developed between the skirt 23 of the perforated shadow mask 21 and the support frame 22 all over the circumference thereof without being laterally displaced or angularly offset relative to the support frame 22.

After the mounting of the perforated shadow mask 21 in the manner as hereinbefore described, the skirt 23 of the perforated shadow mask 21 is welded to the support frame in any suitable manner well known to those skilled in the art thereby completing the perforated shadow mask assembly according to the present invention. During the welding of the skirt 23 to the support frame 22, the perforated shadow mask 21 will neither undergo any lateral displacement nor any angular offset relative to the support frame 22. Therefore, the perforated shadow mask assembly according to the embodiment shown in and described with reference to FIGS. 8 to 10 can exhibit effects similar to those brought about by the perforated shadow mask assembly according to any one of the previously described embodiments of the present invention.

Figure 11A:
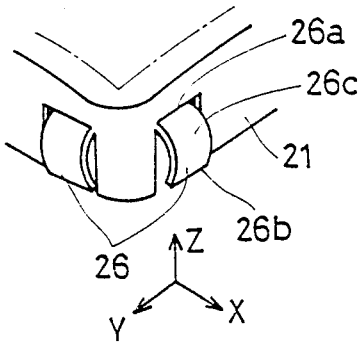
FIGS. 11(*a*) and 11(*b*) are fragmentary perspective views showing one positioning engagement formed in the skirt of the shadow mask according to fourth and fifth preferred embodiment of the present invention, respectively.
Figure 11B:
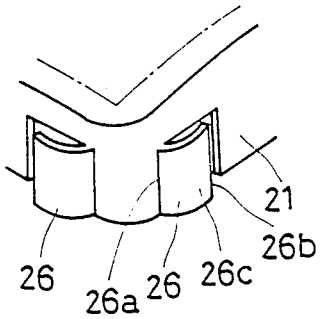
Figure 12A:
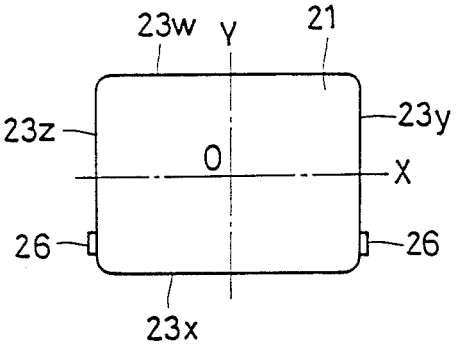
FIGS. 12(*a*) to 12(*d*) are schematic diagrams showing the different disposition of resilient tongues, which form the positioning engagements, in the skirt of the shadow mask.
Figure 12B:
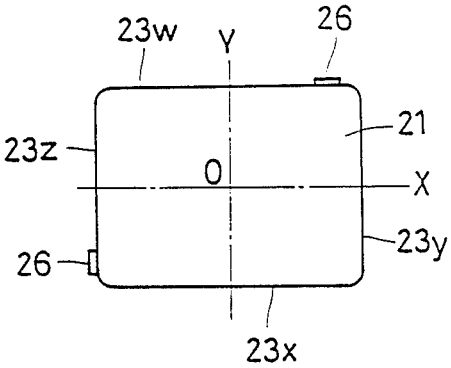
Figure 12C:
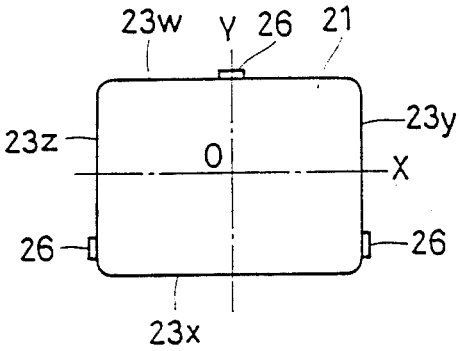
Figure 12D:
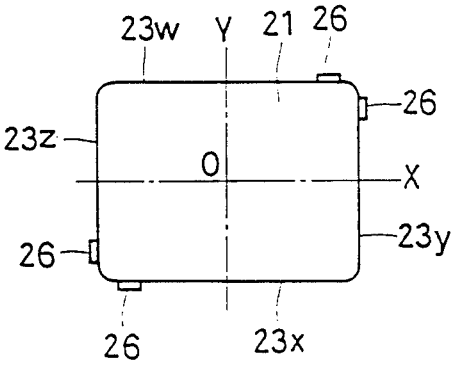

It is to be noted that, although each of the resilient tongues 26 formed in the skirt 23 of the perforated shadow mask 21 has been shown and described as a generally rectangular flat resilient tongue, each FIG. 11(*a*) with a substantially intermediate portion thereof between the hinge 26*a* and a free end 26*b* thereof protruding outwardly from the skirt 23. The use of the curled resilient tongues 26 as shown in FIG. 11(*a*) is advantageous in that during the mounting of the perforated shadow mask 21 relative to the support frame 22 the skirt 23 can readily be slipped into the support frame 22 because of minimized friction occurring between the resilient tongues 26 and the inner wall face of the support frame 22.

In the example shown in any one of FIG. 8 and FIG. 11(*a*), the hinge 26*a* through which each resilient tongue 26 is continued to the skirt 23 of the perforated shadow mask 21 is shown to extend parallel to the circumferential direct ion of the skirt 23 and perpendicular to the longitudinal axis Z of the evacuated envelope. However, the hinge 26*a* may extend substantially perpendicular to the circumferential direction of the skirt 23 and parallel to the longitudinal axis Z of the evacuated envelope as shown in FIG. 11(*b*). If desired, the hinge 26*a* may extend in any suitable direction other than the direction described above.

Also, in the description of the embodiment shown in FIGS. 8 to 10, the use of the eight resilient tongues 26 in total has been shown and described. However, the number of the resilient tongues 26 may not be limited to eight such as shown and described above and the use of two or more resilient tongues 26 can work very well. For example, where the two resilient tongues 26 are employed, they could be positioned in the skirt 23 in symmetrical relationship with respect to the Y-axis of the perforated shadow mask 21 as shown in FIG. 12(*a*) or in symmetrical relationship with respect to X-axis, or they may be positioned in one of the longer side walls, for example, the longer side wall 23*w*, of the skirt 23 and in one of the shorter side walls of the same skirt 23 jointed to the longer side wall 23*w*, that is, the shorter side wall 23*z*, as shown in FIG. 12(*b*).

Alternatively, where the three resilient tongues 26 are employed, they should be positioned on the skirt 23 so as to occupy respective apexes of the shape of a triangle such as shown in FIG. 12(*c*). More specifically, one of the three resilient tongues 26 is formed in an intermediate portion of one of the longer side walls, for example, the longer side wall 23*w*, of the skirt 23 while the remaining two resilient tongues 26 are formed in the opposite shorter side walls 23*y* and 23*z* of the same skirt 23 adjacent the two corners of the support frame 22 remote from the longer side wall 23*w*. Again alternatively, where the four resilient tongues 26 are employed, they may be positioned as shown in FIG. 12(*d*).

According to the arrangement shown in FIG. 12(*d*), the resilient tongues 26 formed in the longer side wall 23*w* and the shorter side wall 23*y* and adjacent the corner defined therebetween confront substantially diagonally with the resilient tongues 26 formed in the longer side wall 23*x* and the shorter side wall 23*y*.

Although in describing the embodiment of FIGS. 8 to 10 the resilient tongues 26 have been shown and described as formed in the skirt 23 of the perforated shadow mask 21, they may be formed in the support frame 22 instead of the skirt 23. Also, each of the resilient tongues 26 may be constituted by a member separate from the skirt 23 of the perforated shadow mask 21 or the support frame 22, in which case the separate resilient tongue has to be welded to the skirt 23 or the support frame 22.

According to the embodiments shown in and described with particular reference to FIGS. 8 to 12, since at least two resilient tongues 26 are formed in either the skirt 23 of the perforated shadow mask 21 or the support frame 22 so that, when the perforated shadow mask 21 is mounted with the skirt 23 on the support frame 22, the resilient tongue 26 can elastically engage the support frame 22 or the skirt 23 of the perforated shadow mask 21 to retain the perforated shadow mask 21 in position on the support frame 22, and consequently, the perforated shadow mask 21 can be retained on the support frame 22 with the exact and accurate position relative to the support frame 22 in the X-Y plane by the action of the resilient forces F exerted by the resilient tongues between the skirt 23 and the support frame 22 with a substantially uniform clearance developed between the skirt 23 and the support frame 22 all over the circumference thereof. Therefore, as is the case with any one of the embodiments described and shown with reference to FIGS. 1 to 7, the use of the complicated and expensive centering and/or repositioning machines and equipment can be advantageously eliminated and, also, the color cathode ray tube employing the shadow mask assembly according to the present invention is effective to display televised pictures without any color deviation.

It is also to be noted that although in the embodiments of FIGS. 4 to 7 and 8 to 12 the skirt 23 of the perforated shadow mask 21 has been shown and described as connected to the inner face of the support frame 22, the skirt 23 can be connected to the outer face of the support frame 22 with the frame 22 being mounted inside the perforated shadow mask 21.

Although the present invention has fully been described in connection with the preferred embodiments thereof with reference to the accompanying drawings used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention delivered from the claims annexed hereto, to be construed as included therein.

What is claimed is:

1. A shadow mask mounting system for a color cathode ray tube, comprising an evacuated envelope having a longitudinal axis and including a generally rectangular faceplate sealed to one of opposite ends of the evacuated envelope and including a phosphor deposited screen plate lying generally perpendicular to the longitudinal axis, which mounting system comprises:

a generally rectangular rigid support frame;

a finely perforated shadow mask mounted across the support frame and having a skirt connected to the support frame;

a plurality of positioning engagements formed in and spacedly distributed around one of the skirt of the perforated shadow mask and the support frame; and a corresponding number of mating engagements formed in the other of the skirt of the perforated shadow mask and the support frame so that, when the perforated shadow mask is mounted on the support frame, the positioning engagements can be engaged with the mating engagements to position the shadow mask relative to the support frame in a plane perpendicular to the longitudinal axis of the evacuated envelope;

wherein one of the positioning engagements and the mating engagements comprises generally elongated, generally semicircular cross-sectioned projections each having its longitudinal axis lying parallel to the longitudinal axis of the evacuated envelope and the other of the positioning engagements and the mating engagements comprises generally V-sectioned recesses, whereby when the perforated shadow mask is mounted relative to the support frame, the projections are received in the respective recesses while forming two line contacts therebetween.

2. A shadow mask mounting system for a color cathode ray tube, comprising an evacuated envelope having a longitudinal axis and including a generally rectangular faceplate sealed to one of opposite ends of the evacuated envelope and including a phosphor deposited screen plate lying generally perpendicular to the longitudinal axis, which mounting system comprises:

a generally rectangular rigid support frame;

a finely perforated shadow mask mounted across the support frame and having a skirt connected to the support frame;

a plurality of positioning engagements formed in and spacedly distributed around one of the skirt of the perforated shadow mask and the support frame; and a corresponding number of mating engagements formed in the other of the skirt of the perforated shadow mask and the support frame so that, when the perforated shadow mask is mounted on the support frame, the positioning engagements can be engaged with the mating engagements to position the shadow mask relative to the support frame in a plane perpendicular to the longitudinal axis of the evacuated envelope;

wherein one of the positioning engagements and the mating engagements comprises generally elongated, generally semicircular cross-sectioned projections each having its longitudinal axis lying parallel to the longitudinal axis of the evacuated envelope and the other of the positioning engagements and the mating engagements comprises generally U-sectioned recesses, whereby when the perforated shadow mask is mounted relative to the support frame, the projections are received in the respective recesses while forming a face contact therebetween.

3. The shadow mask mounting system as claimed in claim 1, wherein both of the support frame and the skirt are constituted by a pair of opposite longer side walls and a pair of opposite shorter side walls assembled together therewith to represent a generally rectangular shape and wherein the positioning engagements are formed in the opposite shorter side walls of the skirt, respectively, in the vicinity of adjacent corners of the skirt and, correspondingly, the mating engagements are formed in the opposite shorter side walls of the support frame.

4. The shadow mask mounting system as claimed in claim 3, wherein the number of the positioning engagements formed in each of the opposite shorter side walls of the skirt is two and, correspondingly, the number of the mating engagements formed in each of the shorter side walls of the support frame is two.

5. The shadow mask mounting system as claimed in claim 1, wherein both of the support frame and the skirt are constituted by a pair of opposite longer side walls and a pair of opposite shorter side walls assembled together therewith to represent a generally rectangular shape and wherein the positioning engagements are formed one in each of at least two side walls of the skirt and, correspondingly, the mating engagements are formed in the associated side walls of the support frame.

6. The shadow mask mounting system as claimed in claim 5, wherein the positioning engagements formed in the at least two side walls of the skirt are positioned in symmetrical relationship with respect to each other about the longitudinal axis of the evacuated envelope and, correspondingly, the mating engagements formed in the corresponding side walls of the support frame are positioned in similarly symmetrical relationship with respect to each other about the longitudinal axis of the evacuated envelope.

7. The shadow mask mounting system as claimed in claim 1, wherein at least one of the positioning engagements and the mating engagements is formed by the use of a press work.

8. The shadow mask mounting system as claimed in claim 1, wherein at least one of the positioning engagements and the mating engagements is formed of a separate member which is fixed to either the skirt or the support frame.

9. A shadow mask mounting in a color cathode ray tube comprising an evacuated envelope having a longitudinal axis and including a generally rectangular faceplate, which faceplate is sealed to one of opposite ends of the evacuated envelope and includes a phosphor deposited screen plate, lying generally perpendicular to the longitudinal axis, which mounting comprises:

a generally rectangular rigid support frame;

a finely perforated shadow mask mounted across the support frame and having a skirt adapted to be received inside the support frame; and a plurality of resilient tongues formed in and spacedly distributed around!nd one of the skirt of the perforated shadow mask and the support frame and operable to position the perforated shadow mask relative to the support frame in a plane perpendicular to the longitudinal axis of the evacuated envelope whereby, when the perforated shadow mask is mounted on the support frame, the resilient tongues can be elastically engaged with the other of the skirt and the support frame to retain the shadow mask in position on the support frame.

10. The shadow mask mounting as claimed in claim 9, wherein each of the resilient tongues is in the form of a generally rectangular flat resilient tongue having one end integrated with one of the skirt and the support frame and the other end protruding from such one of the skirt and the support frame.

11. The shadow mask mounting as claimed in claim 9, wherein each of the resilient tongues is in the form of a generally rectangular curled resilient tongue having one end integrated with one of the skirt and the support frame, a substantially intermediate portion of the curled resilient tongue protruding from such one of the skirt and the support frame.

12. The shadow mask mounting as claimed in claim 11, wherein said one end of the curled resilient tongue and the other end of the same resilient tongue lie generally perpendicular to the longitudinal axis of the evacuated envelope.

13. The shadow mask mounting as claimed in claim 11, wherein said one end of each curled resilient tongue and the other end of the same curled resilient tongue lie substantially parallel to the longitudinal axis of the evacuated envelope.

14. The shadow mask mounting as claimed in claim 9, wherein both of the support frame and the skirt are constituted by a pair of opposite longer side walls and a pair of opposite shorter side walls assembled together therewith to represent a generally rectangular shape and wherein the resilient tongues are formed in said one of the skirt and the support frame in the vicinity of corners of such one of the skirt and the support frame.

15. The shadow mask mounting as claimed in claim 9, wherein both of the support frame and the skirt are constituted by a pair of opposite longer side walls and a pair of opposite shorter side walls assembled together therewith to represent a generally rectangular shape and wherein the two resilient tongues are formed in each of the side walls of said one of the skirt and the support frame in the vicinity of corners of such one of the skirt and the support frame.

16. The shadow mask mounting as claimed in claim 9, wherein both of the support frame and the skirt are constituted by a pair of opposite longer side walls and a pair of opposite shorter side walls assembled together therewith to represent a generally rectangular shape and wherein the resilient tongues are formed one in each of at least two side walls of said one of the skirt and the support frame.

17. The shadow mask mounting as claimed in claim 9, wherein each of the resilient tongues formed in said one of the skirt and the support frame is formed by cutting a corresponding portion of said one of the skirt and the support frame so as to raise from the remaining portion of said one of the skirt and the support frame.

18. The shadow mask mounting as claimed in claim 9, wherein each of the resilient tongues is formed of a generally rectangular member separate from said one of the skirt and the support frame, said rectangular member being fixed at one end to said one of the skirt or the support frame.

19. The shadow mask mounting system as claimed in claim 2, wherein both of the support frame and the skirt are constituted by a pair of opposite longer side walls and a pair of opposite shorter side walls assembled together therewith to represent a generally rectangular shape and wherein the positioning engagements are formed in the opposite shorter side walls of the skirt, respectively, in the vicinity of adjacent corners of the skirt and, correspondingly, the mating engagements are formed in the opposite shorter side walls of the support frame.

20. The shadow mask mounting system as claimed in claim 19, wherein the number of the positioning engagements formed in each of the opposite shorter side walls of the skirt is two and, correspondingly, the number of the mating engagements formed in each of the shorter side walls of the support frame is two.

21. The shadow mask mounting system as claimed in claim 2, wherein both of the support frame and the skirt are constituted by a pair of opposite longer side walls and a pair of opposite shorter side walls assembled together therewith to represent a generally rectangular shape and wherein the positioning engagements are formed one in each of at least two side walls of the skirt and, correspondingly, the mating engagements are formed in the associated side walls of the support frame.

22. The shadow mask mounting system as claimed in claim 21, wherein the positioning engagements formed in the at least two side walls of the skirt are positioned in symmetrical relationship with respect to each other about the longitudinal axis of the evacuated envelope and, correspondingly, the mating engagements formed in the corresponding side walls of the support frame are positioned in similarly symmetrical relationship with respect to each other about the longitudinal axis of the evacuated envelope.

23. The shadow mask mounting system as claimed in claim 2, wherein at least one of the positioning engagements and the mating engagements is formed by the use of a press work.

24. The shadow mask mounting system as claimed in claim 2, wherein at least one of the positioning engagements and the mating engagements is formed of a separate member which is fixed to either the skirt or the support frame.

* * * * *